US007222512B2

(12) United States Patent
Dossmann et al.

(10) Patent No.: US 7,222,512 B2
(45) Date of Patent: May 29, 2007

(54) METHOD AND DEVICE FOR BENDING A CYLINDRICAL TUBE OR THE LIKE

(76) Inventors: Brigitte Dossmann, 1 Rue Du Marsan, Hameau de Craches, Prunay en Yvelines (FR) 78660; Robert Humbert, 25 Route de la Ferte Alais, La Norville (FR) 91290

( * ) Notice: Subject to any disclaimer, the term of this patent is extended or adjusted under 35 U.S.C. 154(b) by 454 days.

(21) Appl. No.: 10/485,883

(22) PCT Filed: Aug. 5, 2002

(86) PCT No.: PCT/FR02/02797

§ 371 (c)(1),
(2), (4) Date: Feb. 5, 2004

(87) PCT Pub. No.: WO03/013755

PCT Pub. Date: Feb. 20, 2003

(65) Prior Publication Data

US 2004/0231394 A1 Nov. 25, 2004

(30) Foreign Application Priority Data

Aug. 6, 2001 (FR) ..... 01 10490

(51) Int. Cl.
*B21D 9/00* (2006.01)
*B21D 39/20* (2006.01)
*B21D 11/00* (2006.01)

(52) U.S. Cl. ..... 72/369; 72/62; 72/307

(58) Field of Classification Search ..... 72/57, 72/58, 62, 307, 369, 370.22, 56

See application file for complete search history.

(56) References Cited

U.S. PATENT DOCUMENTS

| | | | | | |
|---|---|---|---|---|---|
| 1,879,663 | A | * | 9/1932 | Dreyer | 72/62 |
| 3,438,238 | A | * | 4/1969 | Crowe et al. | 72/369 |
| 3,847,184 | A | * | 11/1974 | God | 138/120 |
| 4,205,544 | A | | 6/1980 | Foster | |
| 4,237,713 | A | * | 12/1980 | Benteler et al. | 72/59 |
| 5,735,156 | A | * | 4/1998 | Yoshitomi et al. | 72/57 |
| 6,044,678 | A | * | 4/2000 | Olszewski | 72/59 |

FOREIGN PATENT DOCUMENTS

| | | |
|---|---|---|
| DE | 473 853 | 3/1929 |
| EP | 0 219 453 | 4/1987 |
| EP | 0 770 435 | 5/1997 |
| FR | 2 085 346 | 12/1971 |
| GB | 200 723 | 7/1923 |

* cited by examiner

*Primary Examiner*—Lowell A. Larson
*Assistant Examiner*—Teresa M. Bonk
(74) *Attorney, Agent, or Firm*—Young & Thompson

(57) ABSTRACT

The invention concerns methods and devices for bending a cylindrical tube or the like (1) so as to obtain two consecutive sections (2, 3) of said tube forming between them a non-null angle alpha. The method is essentially characterised in that it consists in producing, in the wall (4) of the tube (1), a wave (20) defined between two flanks (22, 23) forming between them a non-null angle beta substantially centred on the separation plane (21) between the two sections, then in producing a permanent plastic deformation of the wave (20) until the value of the angle between the two sections (2, 3) is obtained. The device enables to implement said method. The invention is useful in particular but not exclusively, for producing pipes for transporting fluids in motor vehicles or the like.

13 Claims, 4 Drawing Sheets

METHOD AND DEVICE FOR BENDING A CYLINDRICAL TUBE OR THE LIKE

BACKGROUND OF THE INVENTION

The present invention relates to methods for curving, or bending in the usual terminology in the art, a tube that is cylindrical or substantially cylindrical, or the like, i.e. of a general shape that even if not purely cylindrical can be considered as having that shape, said substantially cylindrical shape being optionally circularly symmetrical, and optionally rectilinear.

The present invention also relates to apparatus for implementing such methods, having applications that are particularly, but not exclusively, advantageous in making fluid admission and exhaust tube necks for motor vehicle engines.

Methods already exist for curving or bending a cylindrical tube or the like. The simplest method consists in exerting forces on the two segments of tube situated on either side of the location where the bend is to be made, said forces tending to bring said two segments angularly towards each other. That solution presents major drawbacks that are described below.

The tube flattens where it is being bent, thereby changing the size of its cross-section which can constitute a fluid-flow constriction that is unacceptable in certain applications. In addition, cracking occurs at the bend, which weakens the strength of the tube wall and can lead to leaks.

To mitigate those drawbacks, an angularly-deformable guide is placed inside a tube such as a string of cone inserts hinged one after another so that while the tube is being bent, its inside section remains substantially constant.

However, that method still presents a drawback because it can be used only if the segments situated on either side of the bend are relatively long and if the radius of curvature is quite large. It therefore does not enable a sequence of relatively tight bends to be made close to one another.

SUMMARY OF THE INVENTION

An object of the present invention is thus to provide a method of bending a cylindrical tube or the like which mitigates to a considerable extent the drawbacks of prior art methods as outlined above, and which also makes it possible at any point along the tube to obtain bends in three dimensions (3D), i.e. in any of the directions of three-dimensional space.

Another object of the present invention is to provide apparatus enabling the method of the invention to be implemented.

More precisely, the present invention provides a method of bending a cylindrical tube or the like so as to obtain at least two consecutive segments of the tube that make an angle a of given non-zero value between each other, the method being characterized by the fact that it consists:

in making in the wall of the tube a wave defined between two flanks that make a non-zero angle b between each other and that are centered substantially on the plane of separation between the two segments, said wave projecting outwards from the cylindrical wall of the tube, and then in imparting permanent plastic deformation to said projecting wave so as to obtain the given value for the angle a between the two segments.

The present invention also provides apparatus for implementing the above-defined method, for bending a tube in such a manner that two consecutive segments of the tube make a non-zero angle a of given value between each other, the apparatus being characterized by the fact that it comprises, relative to a reference base:

means for making in the wall of the tube a wave projecting outwards from the wall of the tube, said projecting wave being defined between two flanks forming a non-zero angle b between each other and centered substantially on the plane of separation between the two segments; and means for imparting permanent plastic deformation to said wave until the given value is obtained for the angle a between the two segments.

BRIEF DESCRIPTION OF THE DRAWINGS

Other characteristics and advantages of the invention appear from the following description given with reference to the accompanying drawings by way of non-limiting example, in which.

DESCRIPTION OF THE PREFERRED EMBODIMENTS

Although the figures show several embodiments of the invention, the same references are used therein to designate elements that are the same whatever the figure in which they appear and whatever the way in which said elements are shown. Similarly, even if certain elements are not specifically referenced in one of the figures, their references can readily be found by referring to another figure. It is also specified that other embodiments can exist that satisfy the definition of the invention.

Figure 1:
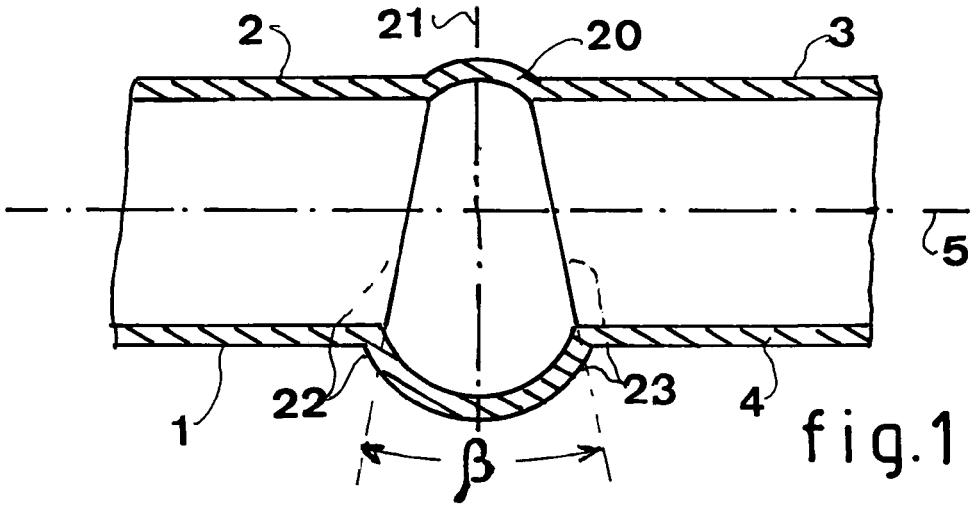
FIGS. 1 to 3 are diagrams showing two steps in the implementation of the method of the invention for bending a substantially cylindrical tube, FIGS. 1 and 2 showing the same step in two respective orthogonal views, and FIG. 3 showing the final step.
Figure 2:
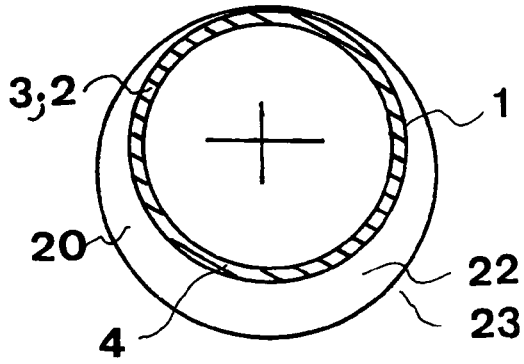
Figure 3:
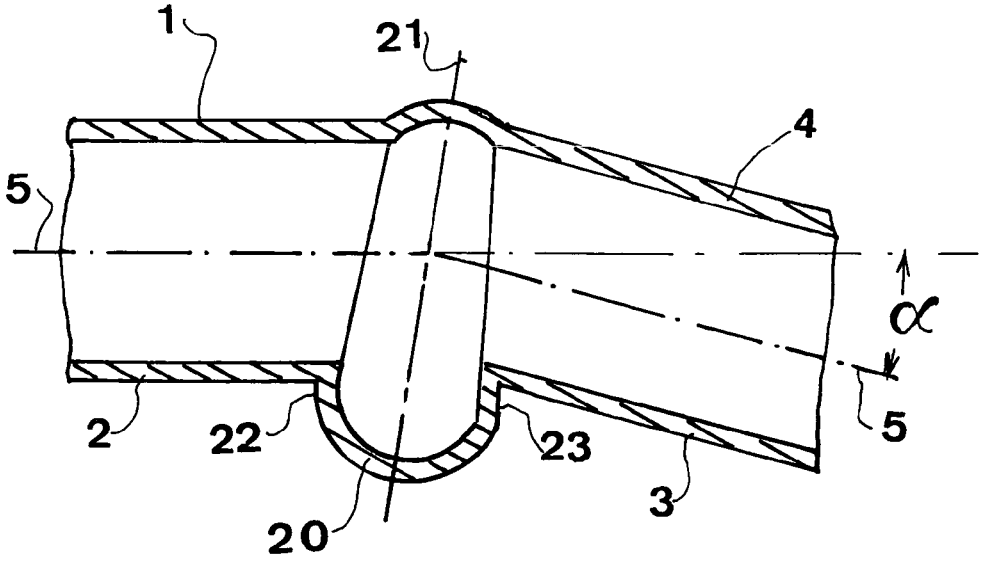

With reference to FIGS. 1 to 3, the method of the invention enables a cylindrical tube 1 or the like or otherwise of general axis 5, e.g. a metal tube made of steel or the like, to be bent so as to obtain two consecutive segments 2, 3 of the tube that are at an angle a of determined non-zero value relative to each other.

In a first step, FIG. 1, implementing the method consists in making a wave 20 in the wall 4 of the tube 1, the wave 20 being defined between two flanks 22, 23 at a non-zero angle b relative to each other and being centered substantially on the plane 21 of separation between the two segments, as shown in FIGS. 1 and 2.

In most applications, it is necessary for the inside section of the tube not to be constricted. Thus, the wave 20 is itself made so as to project outwards from the cylindrical wall 4 of the tube 1, as shown more particularly in FIGS. 1 and 2.

This projecting wave 20 is preferably obtained by causing the wall 4 of the tube 1 to creep by using a deformable body suitable for transmitting pressure, such as a preferably incompressible fluid such as water, oil, a mixture of both, a rubber substance, or the like, or even possibly a gas such as air, which is introduced into a chamber 3 defined inside the tube and substantially centered on the plane 21 of separation between the two segments 2, 3.

Although the above-defined means are preferred, other means may be used, for example mechanical pressure can be applied to the inside face of the wall 4 of the tube 1.

In the figures, the two flanks 22, 23 of the wave 20 are shown as being planes making a non-zero acute angle b relative to each other, however such planes could be replaced by surfaces presenting one or more curves, the plane representation of these flanks forming a dihedral angle giving the general direction of such surfaces.

Thereafter, the method consists in subjecting the wave 20 to permanent plastic deformation (i.e. deformation that is not elastic), until reaching the value given by the angle a between the two segments 2, 3. Such deformation of the wave 20 to obtain the value for the angle a may be of any kind.

In an advantageous implementation, the permanent plastic deformation of the wave 20 is obtained by modifying the value of the angle b until the value of the angle a is obtained between the two segments 2, 3 in application of a relationship that is predetermined by the person skilled in the art in order to obtain the desired bend. Bending may be performed in a single plane, or alternatively in 3D, i.e. making use of the three directions of space.

It should be understood that permanent plastic deformation of a body is deformation obtained by applying forces to the body so as to cause it to pass from an initial state to a final state without destroying the body, and with the body remaining in its final state when the forces are removed.

During experiments undertaken to develop the method of the invention, the Applicants have found that the best results are obtained when the projecting wave 20 is given a shape that is substantially W-shaped, or the like.

It should also be observed, that by implementing the method of the invention, it is possible to bend a tube at a location of its wall that has already been bent, which is not possible with the methods of the prior art.

The present invention also provides apparatus enabling the above-defined method to be implemented.

Figure 4:
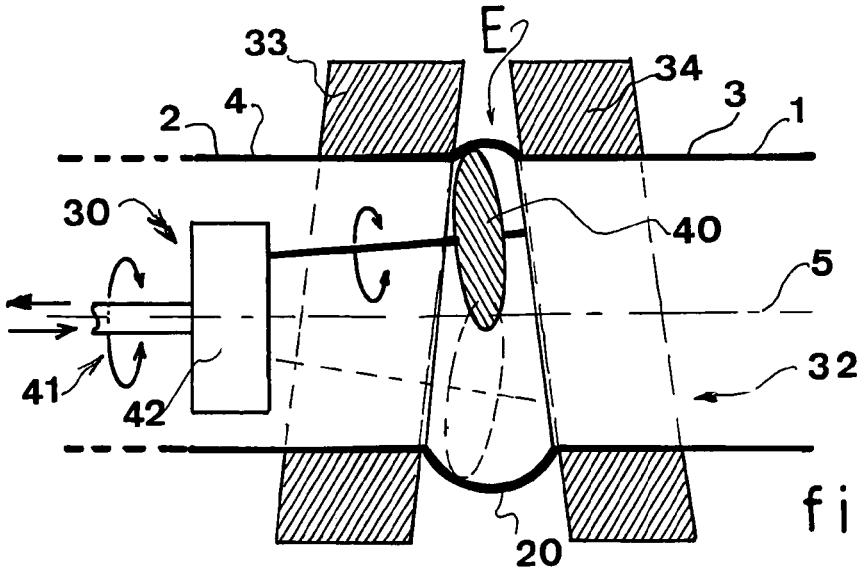
FIGS. 4 and 5 are theoretical diagrams respectively of two embodiments of the apparatus of the invention for implementing the method of the invention for bending a substantially cylindrical tube.
Figure 5:
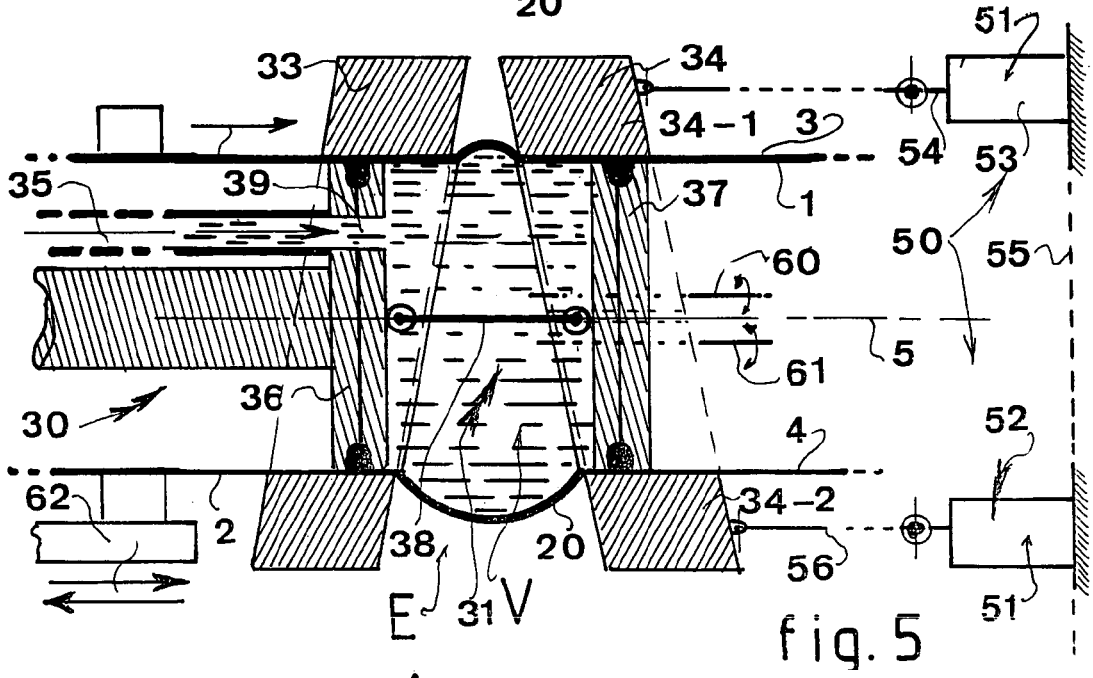

Two first embodiments of the apparatus are shown diagrammatically in FIGS. 4 and 5, which apparatus comprises both means 30 for making in the wall 4 of the tube 1 a wave 20 projecting outwards from the tube wall, defined between two flanks 22, 23 making a non-zero angle b between each other, and centered substantially on the plane 21 of separation between the two segments, and means 50 for imparting permanent plastic deformation to the wave 20 so as to obtain the value for the angle a between the two segments 2, 3.

FIG. 4 is a diagrammatic and fragmentary view of a first possible embodiment of such apparatus.

In this first embodiment, the means 30 for making in the wall 4 of the tube 1 a projecting wave 20 defined between two flanks 22, 23 making a non-zero angle b between each other are constituted by a solid oblong-section wheel 40 or the like, means 41 for holding the solid wheel 40 inside the tube, at least two jaws 33, 34 forming between them a non-zero dihedral angle substantially equal to b, these two jaws being mounted to co-operate with the outside face of the wail 4 of the tube so as to guide formation of the wave 20, and means 42 for moving the solid wheel 40 in translation and in rotation relative to the tube while imparting force thereto to press it against the inside face of the wall 4 of the tube in order to deform it in creep so as to obtain the wave 20.

By way of example, these means 42 may be constituted by a combination of motor elements in series for causing the wheel to rotate about its own axis, to turn about an eccentric axis, and to move in translation parallel to the axis 5 of the tube 1.

In order to obtain a wave 20 with the above-described means, the tube for bending is placed around the means 30 so that the wheel is inside the tube substantially level with the plane 21 of separation, and then the two jaws are brought into contact with the outside face of the wall 4 of the tube 1, as shown in FIG. 4, defining the non-zero angle b. The relative positioning of the jaws is determined so as to obtain the desired bend.

Thereafter, by appropriate programmed control of the apparatus, the wheel is moved in translation and is pivoted so as to apply pressure against the inside face of the tube, so as to impart creep to the material constituting the portion of the wall 4 of the tube that is situated in the space E defined between the two jaws 33 and 34. The movements of the wheel are stopped once the wave has taken the desired and predetermined shape so that after it has been subjected to permanent deformation as defined above in the method, the desired angle a is obtained between the two segments 2, 3 (FIG. 3).

The final bend a is obtained from a wave 20 obtained as described above in the manner defined below when describing the operation of the embodiment shown in FIG. 5.

The embodiment of the means 30 described above enables acceptable results to be obtained, but the embodiment shown diagrammatically in FIG. 5 can be preferable because of the simplicity with which it can be implemented and the very good results it gives in numerous applications.

In this embodiment, the means 30 for making in the wall 4 of the tube 1 a projecting wave 20 defined between two flanks 22, 23 making a non-zero angle b between each other and centered substantially on the plane 21 of separation between the two segments are constituted by a leaktight chamber 31 defined inside the tube and centered substantially on the plane 21 of separation, at least two jaws 33, 34 forming between them a dihedral angle substantially equal to b and mounted to co-operate with the outside face of the wall 4 of the tube 1 to guide formation of the wave, and controllable means 35 for feeding the leaktight chamber 31 with fluid under pressure, and advantageously a fluid that is incompressible.

Advantageously, the leaktight chamber 31 has two pistons 36 and 37 mounted to slide in leaktight manner inside the tube 1 so as to define a leaktight volume V inside the tube, connection means 38 between the two pistons 36, 37 providing connection in particular a connection allowing pivoting so as to make it possible in certain cases to maintain the pistons substantially at a constant distance apart while accepting angular displacement between them, said means 38 possibly being constituted by a link, for example, mounted to pivot at each of its ends on a respective one of the facing faces of the two pistons.

The embodiment described above with reference to FIG. 5 is preferred. Nevertheless, other embodiments can be provided, such as the embodiment (not shown) comprising a chamber constituted, for example, by two pistons enclosing a piece of elastic material such as rubber or the like.

In which case, the pistons are mounted to slide relative to each other and displacement of the pistons is controlled and driven in determined manner so as to compress the piece of elastic material causing it to swell laterally outwards, thereby deforming the wall 4 of the tube so as to provide the desired projecting wave 20 as defined above.

As for the means 50 for imparting permanent plastic deformation to the wave 20 until the angle of value a is obtained between the two segments 2, 3 by varying the non-zero value of the angle b, e.g. by moving the two flanks 22, 23 angularly towards each other, said means advantageously comprise (as shown diagrammatically only in FIG. 5) means 51 for moving at least one (34) of the two jaws 33, 34 relative to the other jaw.

By way of example, these means 51 are constituted by a set of actuators 52, e.g. three actuators mounted in parallel at the vertices of a triangle, with only two of them being shown, e.g. so that their respective cylinders 53 are secured to a base 55 constituted like the base of a machine tool or the like, serving as a reference for all of the means constituting the apparatus.

The rod 54 of each actuator is then connected, e.g. via a cam 56 that is pivotally mounted at both ends, to a single jaw, the jaw 34 in FIG. 5, so as to enable the jaw to be displaced in the three directions of space, i.e. in rotation and/or in translation, as a function of how the actuators are controlled, so as to reduce the space E between the two jaws 33, 34 and impart to the wave 20 held captive between them the desired permanent plastic deformation as explained when describing the method for bending the tube 1 between the two segments 2 and 3.

The above-described means 51 are also provided in the embodiment of FIG. 4, however they are not shown in FIG. 4, solely for the purpose of simplifying the drawing.

Advantageously, both in the embodiment of FIG. 4 and in the embodiment of FIG. 5, at least one (34) of the two jaws 33, 34 (and preferably both of them) is/are constituted by two half-jaws 34-1, 34-2.

Under such circumstances, the apparatus includes means for displacing each half-jaw relative to the other so as to enable the half-jaws to take up two positions, a first position in which the two half-jaws form a single jaw surrounding the outside face of the wall 4 of the tube 1, and in contact therewith, and a second position in which each half-jaw 34-1, 34-2 is spaced apart from the outside face of the wall 4 of the tube.

In FIG. 5, the two half-jaws are mounted to pivot about two optionally coinciding axes 60, 61 so as to co-operate with the outside face of the wall 4 of the tube 1 to take up the two above-defined positions, like the two jaws of a pair of pliers co-operating with a body.

Both in the embodiment of FIG. 4 and in the embodiment of FIG. 5, the apparatus may advantageously further comprise means 62 for controlling movement of the tube 1 in translation and/or in rotation. These means are shown in highly diagrammatic manner since they do not present any difficulty of implementation for the person skilled in the art. By way of example they may be of the type comprising a rack or the like and a fixing ring with pinions suitable for co-operating with the rack, both being controlled stepwise to turn the tube 1 about its axis 5 and/or move it in translation along said axis 5.

The embodiment of the apparatus shown in FIG. 5 operates and is used as follows:

The cylindrical tube or the like 1 is placed in co-operation with the apparatus so that the two pistons 36, 37 slide inside the tube.

The tube is moved in translation by the means 62 until the location where the tube is to be bent is accurately positioned relative to the chamber 31, i.e. until the volume V is substantially centered on the plane 21 of separation between the two segments 2, 3.

With the tube positioned in this way, sealing of the chamber 31 can be improved by radially expanding gaskets on the two pistons against the inside face of the wall 4 of the tube.

The two jaws 33, 34 are then positioned so as to surround the outside face of the wall 4 of the tube, making contact therewith, and relative to each other so as to define the space E of predetermined shape for obtaining the wave 20 as described above. Advantageously, the relative positioning of the two jaws can be refined by suitably controlling the actuators 52 to obtain the predetermined initial value for the angle b.

Following the operation of improving sealing as described above, or simultaneously therewith, when using an incompressible fluid as shown in FIG. 5, the fluid is introduced into the volume V and is then raised to a pressure of determined value so as to obtain, by creep, deformation of the portion of the wall 4 of the tube 1 that occupies the space E defined between the two jaws 33, 34.

Once the wave 20 has taken the desired projecting shape, the rise in the pressure of the fluid inside the chamber 31 is stopped, but the pressure is maintained at a value that is sufficient to maintain the shape of the inside section of the tube 1 while permanent plastic deformation is being imparted to the wave 20, as explained below.

By appropriate control, in particular of the actuators 52, the jaw 34 is moved so as to impart said permanent plastic deformation to the wave 20 that has formed in the space E, e.g. by reducing the non-zero angle b formed initially by the two jaws so as to pivot the two flanks 22, 23 of the wave towards each other, it being understood that if needed for the final bend, the tube 1 can be pivoted about its axis 5 at the same time as the two jaws are moved towards each other, which constitutes an advantage of great importance for obtaining a 3D bend, something that is impossible to obtain with the methods and apparatuses of the prior art.

During this deformation, the segment 3 is moved angularly relative to the segment 2 so as to obtain a bend in the tube 1.

It should be observed that while the tube is being bent, the configuration of the chamber 31 and the presence of the link 38 interconnecting the two pistons 36, 37 enables the two pistons to pivot relative to each other. In the embodiment shown, it is the piston 37 which pivots relative to the piston 36.

Once this first bend has been obtained, it is possible to make a second bend thereafter. To do this, by using the means 62 shown in FIG. 5, the tube 1 is moved in translation to the right over the two pistons 36, 37 to the location where the second bend is to be made. This new bend is obtained in the same manner as the preceding bend.

Clearly all of the parameters for obtaining a bend of angle a in a tube of given structure, for example the relative positioning of the two jaws (in particular the distance between them and the value of the angle b), the value of the pressure applied to the incompressible fluid inside the volume V, and the duration for which said pressure is applied, need to be defined, e.g. experimentally, and stored in reference charts, of graphical, digital, etc. form.

Figure 12:
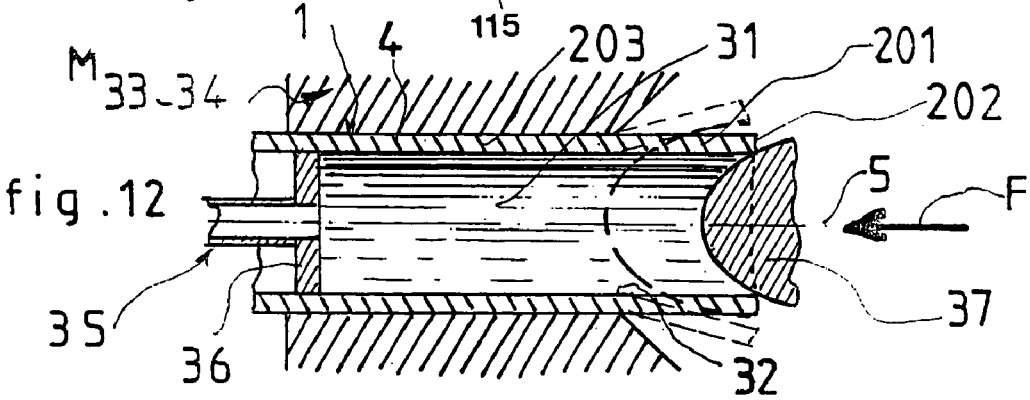
FIG. 12 is a diagrammatic section view of another embodiment of the apparatus of the invention enabling the method of the invention to be implemented to deform one end of the wall of a substantially cylindrical tube, in order to impart a degree of curvature thereto.

FIG. 12 shows another embodiment of the apparatus of the invention when it is necessary, for example, to deform one end 203 of a substantially cylindrical tube 1, in order to give it a certain amount of curvature.

In this embodiment, the apparatus comprises jaw means $M_{33-34}$ for holding the end 203 of the tube 1, these jaw means being shaped to leave uncovered a portion 201 of the wall 4 of the tube 1 adjacent to its free end 202, means inside the tube 1 level with the jaw means $M_{33-34}$ for determining a leaktight chamber 31 between first and second pistons 36, 37, means 35 mounted to co-operate with the first piston 36 to apply pressure to the inside of the chamber 31, the first piston 36 being mounted to slide in leaktight manner inside the tube 1, means for mounting the second piston 37 to co-operate with the jaw means $M_{33-34}$ so as to seal the free end 202 of the tube 1, said second piston 37 also being shaped so as to constitute a die, and means for exerting a thrust force F on said second piston 37 substantially along the longitudinal axis 5 of the tube 1 tending to move it towards the first piston 36.

The apparatus of the invention as described above with reference to FIG. 12 operates as follows:

Pressure is applied inside the leaktight chamber 31, e.g. using water under pressure, and substantially simultaneously, the die-forming second piston 37 is moved in translation towards the first piston 36 using the force F.

Under the pressure of the water, the wall 4 of the tube 1 tends to expand and become pressed hard against the jaw means $M_{33-34}$, and the force F which is applied to the second piston 37 is transmitted to the portion 201 of the tube that is not covered by the jaw means $M_{33-34}$, which portion can thus deform, e.g. to form the beginning of a wave 20 or the like projecting outwards from the cylindrical wall 4 of the tube 1, as represented by dashed lines in FIG. 12.

This embodiment of the apparatus of the invention is particularly advantageous for deforming the ends of tubes, and presents a considerable advantage compared with prior art apparatuses since it requires only a very short holding length for the jaw means $M_{33-34}$, since the pressure that exists inside the chamber 31 ensures that the wall 4 of the tube 1 is pressed tightly against the load-bearing surfaces of said jaw means while the portion 201 at the end 203 of the tube 1 is simultaneously being subjected to deformation. With this embodiment, even under thrust F, the tube 1 remains accurately positioned relative to the jaw means and does not have any tendency to slip relative thereto.

The method and the apparatus of the invention finds particularly advantageous applications in making tube necks for conveying fluids, particularly in the field of motor vehicles or the like where, because of the never-ending search for space saving, it is necessary to make tube necks with numerous bends of all shapes, often together with bellows for damping the vibration produced by engines.

In particular, the hydroforming technique as implemented in the embodiment of FIG. 5 presents the advantage of making it possible not only to make bends of all shapes, but also to make bellows.

Figure 6:
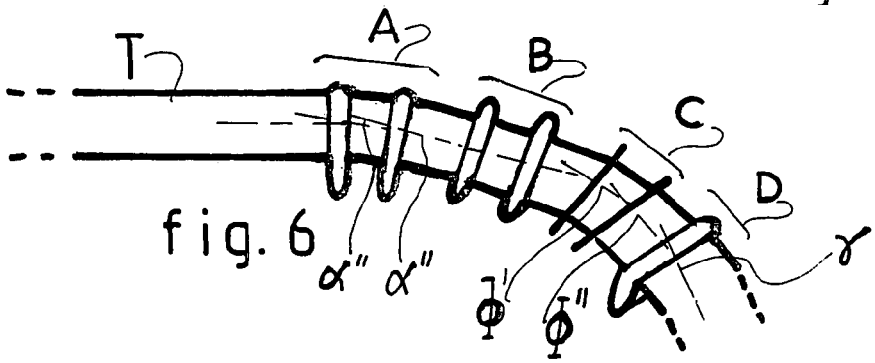
FIG. 6 is a diagram for illustrative purposes showing a tube bent at a plurality of locations with different types of bend, by applying the method of the invention.

By way of example, FIG. 6 shows the shape that can be obtained for a tube T using the method and apparatus of the invention.

The tube T comprises four zones A, B, C, and D.

The zone A comprises a first bend obtained by means of two waves deformed at least in part so as to obtain a bend of angle a which constitutes the sum of two successive bends having respective values a' and a".

The zone B is rectilinear and includes two waves constituting bellows for absorbing vibration in a manner that is well known in the prior art and does not come within the ambit of the present invention.

The zone C has a second bend obtained by means of two waves that are deformed until they have been completely flattened, so as to obtain a bend of angle f obtained as the sum of two successive bends of values f' and f".

The zone D has a third bend obtained by means of a single wave that is deformed at least in part and that is also self-blocking so as to obtain a bend of angle g in a single operation.

Finally, it is clear that apparatus of the invention can easily be automated and controlled by a programmable controller of the same type as those that are to be found on numerically-controlled machine tools, thereby enabling the cost of manufacturing tube necks of this type to be reduced.

Figure 7:
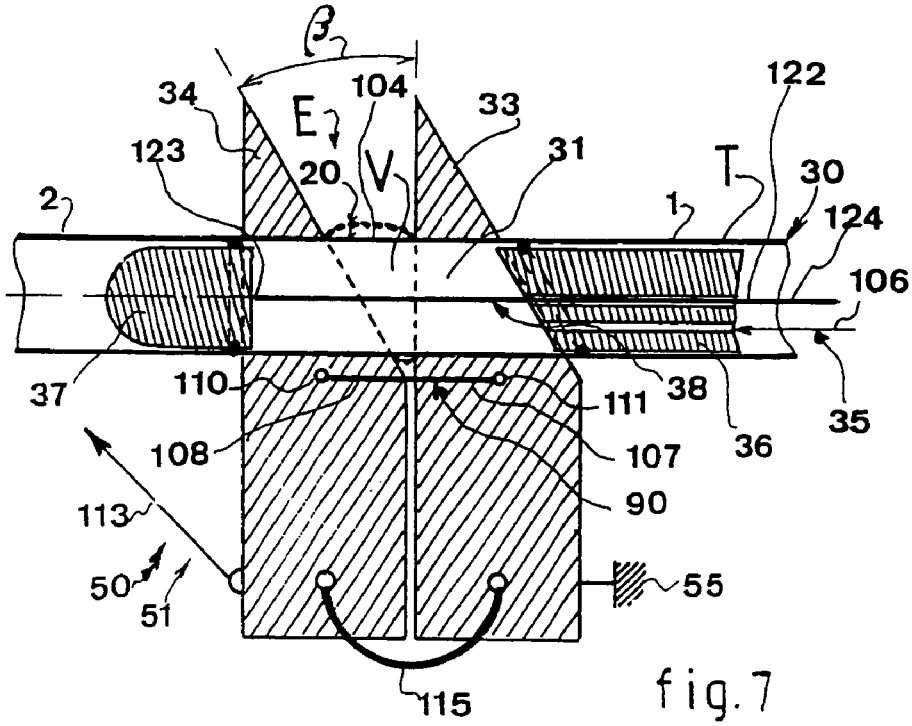
FIGS. 7 and 8 are theoretical diagrams of another embodiment of the apparatus of the invention for implementing the method of the invention for bending a substantially cylindrical tube, FIG. 7 showing the apparatus in its initial configuration prior to the tube being bent, and FIG. 8 showing the apparatus in its configuration immediately after the tube has been bent.
Figure 8:
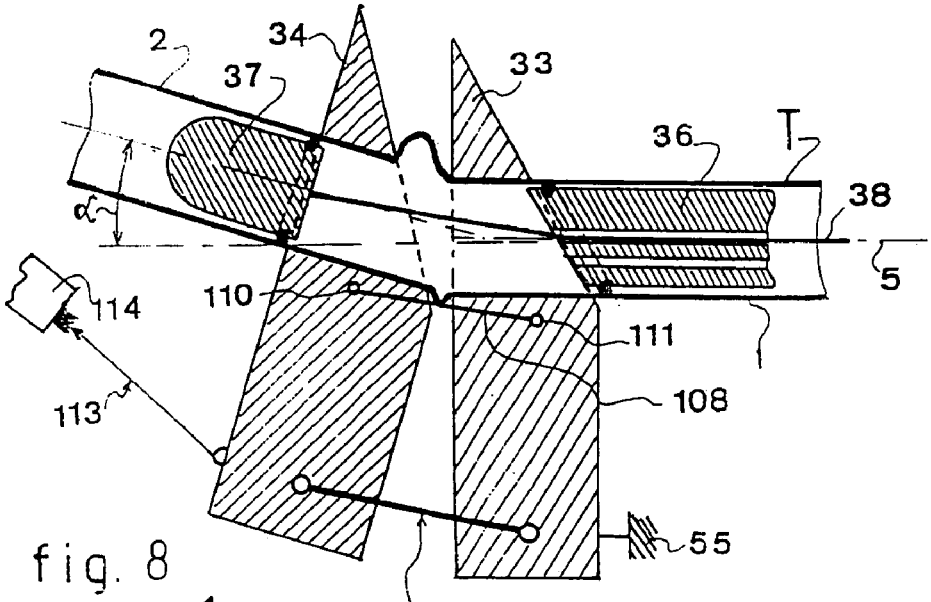

FIGS. 7 and 8 show another advantageous embodiment of the apparatus of the invention for bending a tube T by the method of the invention in such a manner that two consecutive segments 2, 3 of the tube make a non-zero angle a relative to each other, as explained above.

As in the embodiment described above, the apparatus in the embodiment shown diagrammatically in FIGS. 7 and 8 comprises both means 30 for making in the wall 4 of the tube 1 a wave 20 projecting outwards from the wall of the tube and defined between two flanks 22, 23 making a non-zero angle b between each other, and means 50 for imparting permanent plastic deformation to the wave 20 so as to obtain the angle of value a between the two segments 2, 3 by varying the value of the non-zero angle b.

In this embodiment, the means 30 may be of the same type as those described in the preceding embodiments, for example. In particular, they comprise at least two jaws 33, 34 each formed by two half-jaws so as to enable them to be placed around the tube and subsequently removed. Between them they enable a portion 104 of the wall 4 of the tube 1 to be defined within a dihedral angle b, in which portion the wave 20 can be formed once the fluid under pressure 106 is applied to the leaktight chamber 31 defined in the manner described above.

As for the means 50 for imparting permanent plastic deformation to the wave 20, e.g. by angularly moving the two flanks 22, 23 angularly towards each other, comprising means 51 for moving at least one (34) of the two jaws 33, 34 relative to each other, as described above, these means are constituted by means 90 for mounting the jaws so that they can be pivoted relative to each other.

These means 90 include link means 108 of constant and determined length with respective ends pivotally connected to each of the jaws 33, 34 substantially at the level 107 of the portion of the wall 4 of the tube that is situated substantially at the dihedral angle vertex b so that said ends can pivot substantially about straight lines passing through the anchor points 110, 111 of these link means.

The means 90 further comprise means 113 for causing the jaws to pivot about the anchor points 110, 111 so as to decrease the value of the angle b, as can be seen by comparing FIGS. 7 and 8, thereby obtaining, as described above, permanent plastic deformation of the wall 20 by flattening said wave 20 at least in part so as to obtain an angle of value a between the two segments 2, 3.

These means 113 are advantageously constituted by actuator means 114 having one end connected to one (34) of the jaws and an opposite end connected to a fixed point of a base 55 (shown diagrammatically in FIG. 5 in order to simplify the drawings) on which the apparatus is placed, with the other jaw 33 being connected to said fixed point either directly or indirectly.

In an advantageous embodiment, the apparatus further comprises a flexible second link 115 of given maximum length, e.g. a cable, a chain, a telescopic rod or the like, with the two ends of this second link being respectively associated with each of the jaws 33, 34 at points situated a certain distance away from the fastening points of the two ends of the link means, the maximum length given by this second link 115 being determined so as to define a maximum amount of pivoting of the two jaws relative to each other. This maximum amount of pivoting is obtained when the second link 115 has been tensioned to its maximum length.

FIG. 8 shows the position of the two jaws after one of them, specifically the jaw 34, has been subjected to maximum pivoting relative to the other jaw 33.

Furthermore, in a preferred embodiment of the apparatus, the means 30 comprise two pistons, a main piston 36 and an auxiliary piston 37 suitable for sliding in leaktight manner inside the tube 1 and connected to each other so as to define the chamber 31 between them in the manner described above. The main piston 36 is preferably mounted stationary relative to the base of the apparatus and, as mentioned for the above-described embodiments, pivoting link means are provided to hold the two pistons together while allowing angular displacement between them.

Advantageously, the rotary link means for holding the two pistons together while allowing angular displacement between them are constituted, in the embodiment of FIGS. 7 and 8, by a first flexible link 122, such as a cable or the like, having a first end 123 connected to one of the two pistons, advantageously, the auxiliary piston 37, said flexible link passing through the main piston 36 so that its other end 125 emerges from the main piston and can be accessible to exert traction between itself and the main piston, and by means for exerting said traction in order to adjust the distance between the two pistons and thus the length of the chamber 31 along the axis of the tube T, e.g. as a function of the number of waves desired and thus the number of jaws required.

The apparatus of the embodiment shown diagrammatically in FIGS. 7 and 8 operates as follows:

A rectilinear tube T is engaged on the two pistons 36, 37 so that the chamber 31 is formed at the location where the tube is to be bent, and then the jaws are positioned around the tube as shown in FIG. 7 level with the chamber 31. The fluid under pressure 106 is then applied in the chamber 31 so as to obtain by plastic deformation of the wall of the tube T the wave 20 as shown in dashed lines in FIG. 7 and as explained above. The jaws are then pivoted by turning about the two fastening points 110, 111 of the link 108, e.g. by means of the actuator 114 so as to occupy positions as shown in FIG. 8.

During this pivoting of the two jaws 33, 34, the wave 20 deforms by becoming flattened and the tube bends as described above to have a bend angle a, with this amount of tube bending being made possible by the flexible cable 122 interconnecting the two pistons 36 and 37.

Once the tube T has been bent, the jaws are withdrawn and the tube is slid over the two pistons, preferably towards the auxiliary piston 37. This sliding is possible because the auxiliary piston 37 is very short and is flexibly connected to pivot relative to the main piston 36. It can thus easily pass through the position where the tube T has been bent.

Figure 9:
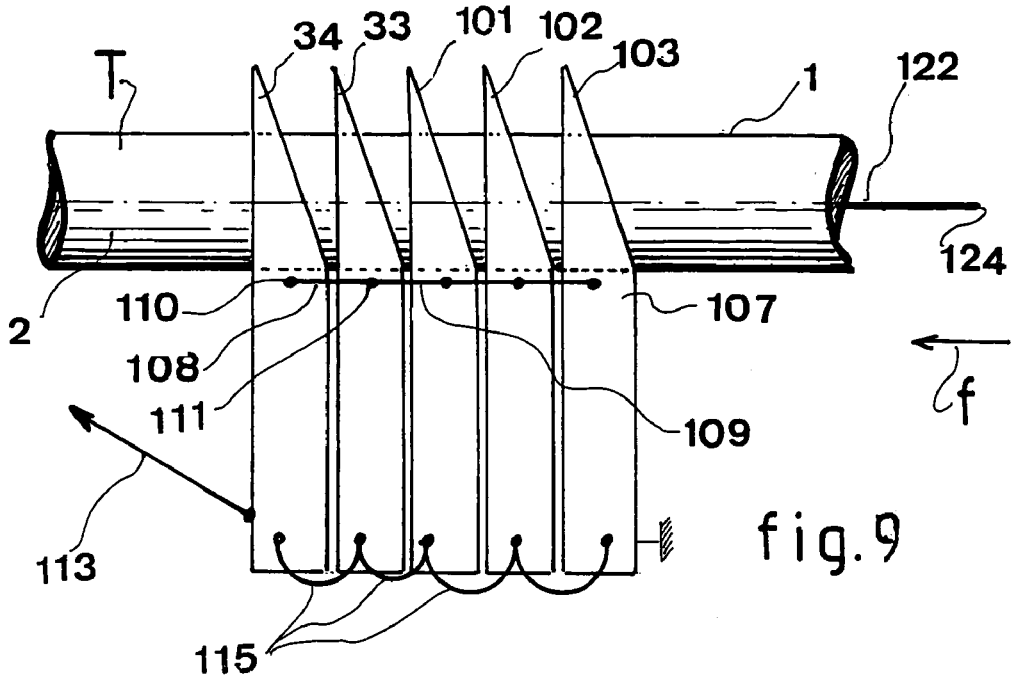
FIGS. 9 and 10 are respectively a side view and an end view constituting theoretical diagrams of another embodiment of the apparatus of the invention for implementing the method of the invention for bending a substantially cylindrical tube at four locations, using the technique implemented by the apparatus of FIGS. 7 and 8.
Figure 10:
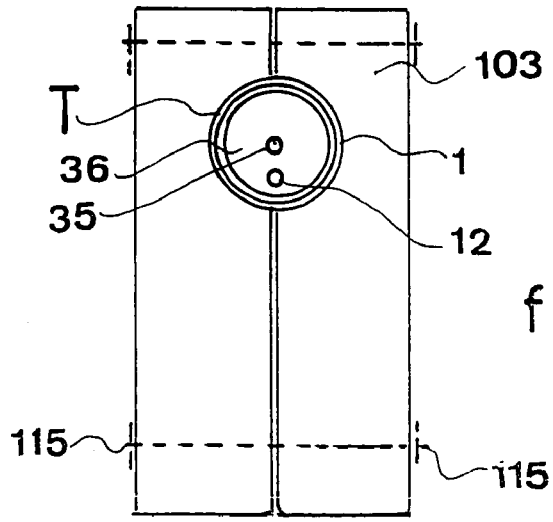

With reference to FIGS. 9 and 10, FIG. 10 is an end view seen looking along arrow f shown in FIG. 9, in which there can be seen another embodiment of the apparatus of the invention which is derived from the embodiment of FIGS. 7 and 8. The apparatus in this embodiment differs from that of FIGS. 7 and 8 by the fact that in addition to the two jaws 33, 34, it further comprises three other jaws 101, 102, and 103 for obtaining four dihedral angles b that are identical or different, and thus four waves 20, with it being possible to pivot the jaws 3, 34, 101, 102, and 103 relative to one another until the four links 115 are under maximum tension, which links may indeed be of different lengths in order to modulate the amount of pivoting that is possible between the five jaws relative to one another.

Figure 11:
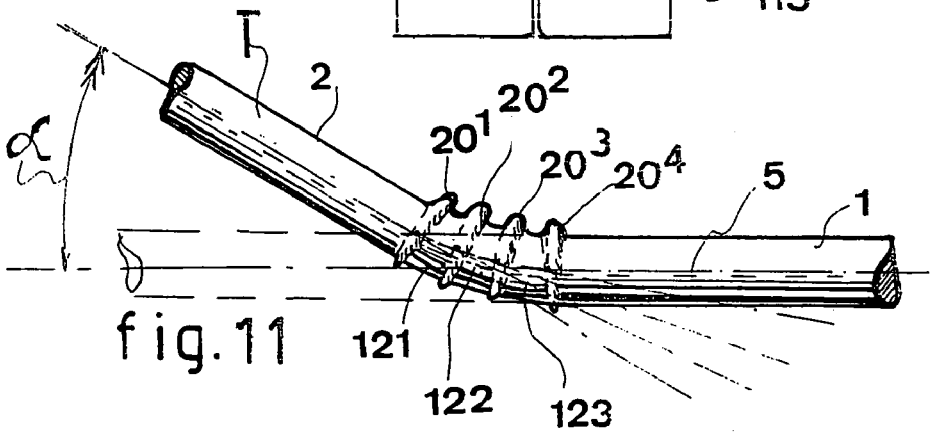
FIG. 11 is a diagram for illustrative purposes showing a bent tube obtained with the embodiment of the apparatus shown in FIGS. 9 and 10.

By way of illustration, FIG. 11 shows a tube T that has been bent in three portions 121, 122, and 123 defined between four waves $\mathbf{20}^1$, $\mathbf{20}^2$, $\mathbf{20}^3$, and $\mathbf{20}^4$ that have been plastically deformed by the method, so as to obtain a final angle a between the two segments 2 and 3.

The invention claimed is:

1. Apparatus for bending a tube (1) in such a manner that two consecutive segments (2, 3) of the tube make a non-zero angle a of given value between each other, the apparatus, comprising, relative to a reference base (55):

means (30) for making in the wall (4) of the tube (1) a wave (20) projecting outwards from the wall of the tube all around the wall of the tube, said projecting wave being defined between two flanks (22, 23) forming a nonzero angle b between each other and centered substantially on the plane (21) of separation between the two segments; and means (50) for imparting permanent plastic deformation to said wave (20) until the given value is obtained for the angle a between the two segments (2, 3), wherein the means (30) for making in the wall (4) of the tube (1) a projecting wave (20) defined between two flanks (22, 23) forming a nonzero angle b between each other and centered substantially on the plane (21) of separation between the two segments are constituted by:

a chamber (31) defined inside the tube and centered substantially on said plane (21) of separation; and at least two jaws (33, 34) forming between them a dihedral angle substantially of said non-zero value b, said jaws being mounted to co-operate with the outside face of the wall (4) of the tube (1) to guide formation of the wave.

2. Apparatus according to claim 1, characterized by the fact that said chamber (31) is a leaktight chamber, said leaktight chamber extending between two pistons (36, 37) slidably mounted in leaktight manner in the tube (1) to define a leaktight volume (V) inside the tube (1) and containing link means (38) between the two pistons.

3. Apparatus according to claim 2, characterized by the fact that the link means (38) provide pivotal linking to hold the two pistons together while accepting angular displacement between them.

4. Apparatus according to claim 3, characterized by the fact that the pivotal link means for holding the two pistons together while accepting angular displacement between them are constituted by a first flexible link (122) having a first end (123) connected to one (37) of the two pistons, said flexible link passing through the other piston (36), and means for exerting traction between the second end (124) of said link and said other piston (36).

5. Apparatus for bending a tube (1) in such a manner that two consecutive segments (2, 3) of the tube make a non-zero angle a of given value between each other, the apparatus comprising, relative to a reference base (55):

a device (30) for making in the wall (4) of the tube (1) a wave (20) projecting outwards from the wall of the tube, said projecting wave being defined between two flanks (22, 23) forming a non-zero angle b between each other and centered substantially on the plane (21) of separation between the two segments, the device comprising a chamber (31) defined inside the tube and centered substantially on said plane (21) of separation and at least two jaws (33, 34) forming between them a dihedral angle substantially of said non-zero value b, said jaws being mounted to co-operate with the outside face of the wall (4) of the tube (1) to guide formation of the wave; and means (50) for imparting permanent plastic deformation to said wave (20) until the given value is obtained for the angle a between the two segments (2, 3), wherein the means (50) for imparting plastic deformation comprises means (51) for moving at least one (34) of the two jaws (33, 34) relative to the other jaw.

6. Apparatus according to claim 5, characterized by the fact that the means (51) for moving at least one (34) of the two jaws (33, 34) relative to the other jaw are constituted by means (90) for mounting the two jaws pivotally relative to each other, and control means (113) for pivoting said two jaws.

7. Apparatus according to claim 6, characterized by the fact that the means (90) for mounting the two jaws pivotally relative to each other are constituted by means of a link (108) of constant length whose two ends are pivotally connected to each of the jaws respectively in such a manner that the two jaws (33, 34) can pivot substantially about respective parallel straight lines passing through the fastening points (110, 111) of the link.

8. Apparatus according to claim 6, characterized by the fact that the means (113) for controlling pivoting of the two jaws are constituted by actuator means (114) having one end connected to one (34) of the jaws and the other end to a fixed point of the base (55), the other jaw being connected to said fixed point.

9. Apparatus according to claim 8, characterized by the fact that it further comprises a second link (115) of given maximum length, the two ends of said second link being associated respectively with each of the jaws at points that are situated at a certain distance away from the fastening points (110, 111) of the two ends of the link means, the given maximum length of said second link (115) being determined so as to define a maximum amount of pivoting of the two jaws relative to each other.

10. Apparatus according to claim 2, characterized by the fact that the link means (38) between the two pistons are pivotal link means for maintaining the two pistons at substantially constant distance apart from each other while accepting angular displacement between them.

11. Apparatus for bending a tube (1) in such a manner that two consecutive segments (2, 3) of the tube make a non-zero angle a of given value between each other, the apparatus comprising, relative to a reference base (55):

means (30) for making in the wall (4) of the tube (1) a wave (20) projecting outwards from the wall of the tube all around the wall of the tube, said projecting wave being defined between two flanks (22, 23) forming a nonzero angle b between each other and centered substantially on the plane (21) of separation between the two segments; and means (50) for imparting permanent plastic deformation to said wave (20) until the given value is obtained for the angle a between the two segments (2, 3), wherein the means (30) for making in the wall (4) of the tube (1) a projecting wave (20) defined between two flanks (22, 23) forming a nonzero angle b between each other and centered substantially on the plane (21) of separation between the two segments, are constituted by:

a solid oblong-section wheel (40);

means (41) for holding said solid wheel (40) inside the tube;

at least two jaws (33, 34) forming between them a dihedral angle substantially of the non-zero value b, said jaws being mounted to co-operate with the outside face of the wall (4) of the tube to guide formation of the wave (2); and means (42) for moving the solid wheel (40) in translation and in rotation relative to the tube while imparting a force thereto so as to press the wheel against the inside face of the wall (4) of the tube to deform it in creep so as to obtain said wave (20).

12. Apparatus according to claim 1, characterized by the fact that at least one (34) of the two jaws (33, 34) is constituted by two half-jaws (34-1, 34-2), and that it includes means for moving each half-jaw relative to the other in such a manner as to enable them to take up two positions, a first position in which the two half-jaws form a single jaw surrounding the outside face of the wall (4) of the tube (1) and in contact therewith, and a second position in which each half-jaw (34-1, 342) is spaced apart from the outside face of the wall (4) of the tube, and means (62) for controlling movement in translation and/or in rotation of the tube (1).

13. The apparatus of claim 1, further comprising a body inside said chamber (31) that is deformable and suitable for transmitting pressure.

* * * * *